US011498339B2

(12) United States Patent
Miyamoto et al.

(10) Patent No.: US 11,498,339 B2
(45) Date of Patent: Nov. 15, 2022

(54) INK-JET PRINTING APPARATUS

(71) Applicant: CANON KABUSHIKI KAISHA, Tokyo (JP)

(72) Inventors: Hiroshi Miyamoto, Kanagawa (JP); Yasunori Takei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/153,437

(22) Filed: Jan. 20, 2021

(65) Prior Publication Data

US 2021/0229448 A1 Jul. 29, 2021

(30) Foreign Application Priority Data

Jan. 27, 2020 (JP) ..... JP2020-011245
Nov. 2, 2020 (JP) ..... JP2020-183922

(51) Int. Cl.
*B41J 2/175* (2006.01)
*B41J 29/02* (2006.01)

(52) U.S. Cl.
CPC ..... *B41J 2/1752* (2013.01); *B41J 2/17566* (2013.01); *B41J 29/02* (2013.01); *B41J 2002/17576* (2013.01)

(58) Field of Classification Search
CPC .... B41J 2/175; B41J 2/17506; B41J 2/17509; B41J 2/17513; B41J 2/1752; B41J 2/17553; B41J 2/17566; B41J 29/02; B41J 29/13; B41J 2002/17573; B41J 2002/17576
See application file for complete search history.

(56) References Cited

U.S. PATENT DOCUMENTS 5,997,121 A * 12/1999 Altfather ..... B41J 2/17566 347/7
8,272,721 B2 * 9/2012 Umeda ..... B41J 2/17509 347/85
10,926,545 B2 * 2/2021 Tanabe ..... B41J 2/17566
2006/0203047 A1 * 9/2006 Koga ..... B41J 2/17509 347/85
2014/0292958 A1 * 10/2014 Tomoguchi ..... B41J 2/17513 347/86
2020/0070528 A1 * 3/2020 Ishibe ..... B41J 2/17553

FOREIGN PATENT DOCUMENTS

JP 2019025818 A 2/2019

* cited by examiner

*Primary Examiner* — Anh T Vo
(74) *Attorney, Agent, or Firm* — Canon U.S.A., Inc. I.P. Division

(57) ABSTRACT

An ink-jet printing apparatus includes an ink-cartridge mounting unit to which an ink cartridge having a first ink chamber containing ink is to be mounted, and a second ink chamber. The second ink chamber stores ink supplied from the first ink chamber. The ink-jet printing apparatus is configured such that, in a case where the ink cartridge is mounted to the ink-cartridge mounting unit, the second ink chamber can be viewed from outside of the ink-jet printing apparatus. An equation $0.5 \leq L \leq d \leq 1.2\ L$ is satisfied, where d is a length of the second ink chamber, and L is a length of the ink cartridge in a direction in which the ink cartridge is inserted into the ink-jet printing apparatus.

17 Claims, 8 Drawing Sheets

INK-JET PRINTING APPARATUS

BACKGROUND

Field

The present disclosure relates to ink-jet printing apparatuses.

Description of the Related Art

Japanese Patent Laid-Open No. 2019-25818 discloses an ink-jet printing apparatus including a chamber storing ink and a head that ejects ink supplied from the chamber through ejection ports. Such a chamber is called a subtank and communicates with the atmosphere through a communicating portion.

An ink cartridge containing ink is mounted to the ink-jet printing apparatus. The ink cartridge includes a chamber that contains ink (a first ink chamber). The first ink chamber communicates with the atmosphere through a communicating portion. When the ink cartridge is mounted to the ink-jet printing apparatus, the ink is supplied from the first ink chamber of the ink cartridge to a subtank (a second ink chamber) of the ink-jet printing apparatus.

The ink-jet printing apparatus described in Japanese Patent Laid-Open No. 2019-25818 includes a rotatable member rotatably supported in the second ink chamber. The rotatable member includes a float with a lower specific gravity than that of ink and a detection portion to be detected by a sensor and extending from the float. If the liquid surface of the ink stored in the second ink chamber is higher than a predetermined height, the rotatable member is positioned at a predetermined position owing to the buoyancy of the ink. When the liquid surface of the ink stored in the second ink chamber decreases to equal to or less than the predetermined height, the rotatable member is rotated by gravity. When the rotatable member rotates, the detection portion moves, and the movement of the detection portion is detected by the sensor. Thus, the amount of ink remaining in the chamber is determined.

As described above, when an ink cartridge is mounted to the ink-jet printing apparatus described in Japanese Patent Laid-Open No. 2019-25818, ink is supplied from the first ink chamber of the ink cartridge to the second ink chamber of the ink-jet printing apparatus. Since the second ink chamber includes the rotatable member, the amount of ink supplied and stored in the second ink chamber can be determined by the rotatable member and the sensor.

The ink cartridge mounted to the ink-jet printing apparatus and the first ink chamber in the ink cartridge can be viewed by the user from the outside.

In contrast, the second ink chamber of the ink-jet printing apparatus is disposed deeper (more inside) than the mounted ink cartridge. For this reason, the second ink chamber cannot be viewed by the user from the outside with the ink cartridge mounted. This exerts no influence on printing by the ink-jet printing apparatus because the user can suppose that the second ink chamber has been supplied with ink from the first ink chamber using the rotatable member and the sensor. However, the user may be given a feeling that the ink in the first ink chamber of the ink cartridge has been decreased and the ink is consumed before printing (ejection of the ink) only by mounting the ink cartridge.

SUMMARY

According to an aspect of the present disclosure, an ink-jet printing apparatus includes an ink-cartridge mounting unit to which an ink cartridge having a first ink chamber configured to contain ink is to be mounted, and a second ink chamber configured to store ink supplied from the first ink chamber, wherein the ink-jet printing apparatus is configured such that, in a case where the ink cartridge is mounted to the ink-cartridge mounting unit, the second ink chamber can be viewed from outside of the ink-jet printing apparatus, and wherein $0.5\ L \leq d \leq 1.2\ L$ is satisfied, where d is a length of the second ink chamber, and L is a length of the ink cartridge in a direction in which the ink cartridge is inserted into the ink-jet printing apparatus.

Further features of the present disclosure will become apparent from the following description of exemplary embodiments with reference to the attached drawings.

DESCRIPTION OF THE EMBODIMENTS

The present disclosure provides an ink-jet printing apparatus configured not to give the user a feeling that ink has been consumed even though not used for printing with an ink cartridge mounted to the ink-jet printing apparatus.

Embodiments of the present disclosure will be described hereinbelow with reference to the drawings. In the following description, components having the same function are given the same reference signs, and descriptions thereof may be omitted.

Figure 1:
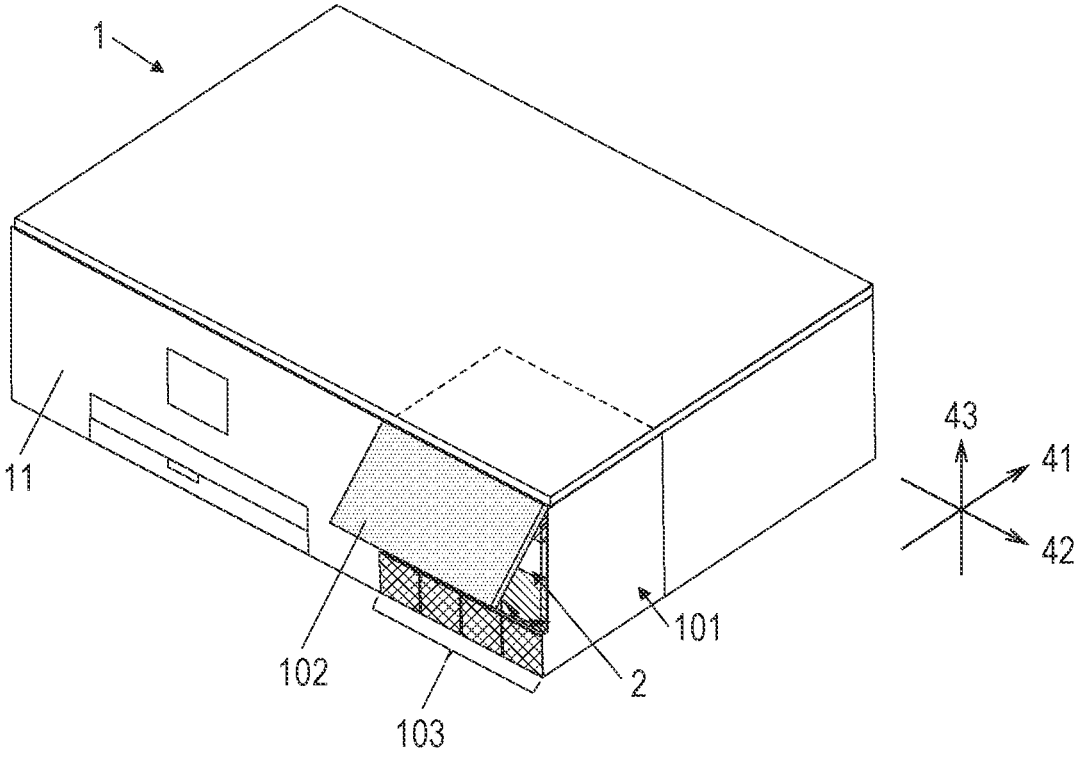
FIG. 1 is a perspective view of an ink-jet printing apparatus according to an embodiment of the present disclosure.

FIG. 1 is a perspective view of an ink-jet printing apparatus according to an embodiment of the present disclosure. The ink-jet printing apparatus 1 is mainly formed of a casing 11. The ink-jet printing apparatus 1 includes an ink-cartridge mounting unit 101 to which ink cartridges are to be mounted. The ink-cartridge mounting unit 101 constitutes a portion to which ink cartridges are to be mounted together with the casing 11. The ink-jet printing apparatus 1 shown in FIG. 1 is fitted with four ink cartridges 2. The ink cartridges 2 are mounted on the back of a colored member (a case cover) 102 provided at part of the ink-cartridge mounting unit 101. In the configuration shown in FIG. 1, the ink cartridges 2 are mounted by opening the case cover 102 upward and then inserting the ink cartridges 2 into the casing 11 in the horizontal direction. The ink cartridges 2 are partially covered with the colored case cover 102 in a state in which the ink cartridges 2 are mounted to the ink-cartridge mounting unit 101. The state in which the ink cartridges 2 are mounted to the ink-cartridge mounting unit 101 refers to a state in which the ink cartridges 2 are mounted to the ink-cartridge mounting unit 101, and ink can be supplied from the ink cartridges 2 to the recording head. An example of the state in which the ink cartridges 2 are mounted to the ink-cartridge mounting unit 101 is a state in which, if the case cover 102 is disposed at the ink-cartridge mounting unit 101, the ink cartridges 2 are inserted into the ink-cartridge mounting unit 101, and then the case cover 102 is closed.

The ink-jet printing apparatus 1 includes, in the casing 11, a head that ejects ink toward a recording medium, such as paper, from ejection ports and a conveying member that conveys the recording medium. A member (a window) 103 extending along the casing 11 is provided at a vertically lower portion of the ink-cartridge mounting unit 101 to which the ink cartridges 2 are mounted. The window 103 is made of a transparent (colorless) member (for example, transparent plastic or glass). The details of the window 103 will be described later. In this specification, "above" refers to vertically above when the ink-jet printing apparatus 1 is in use. Specifically, the above is the direction of arrow 43 in FIG. 1. Arrow 43, arrow 41, and arrow 42 are orthogonal to one another. Arrow 41 extends along the depth direction of the ink-jet printing apparatus 1, and arrow 42 extends along the width direction of the ink-jet printing apparatus 1. Arrow 41 and arrow 42 extend in the horizontal direction.

Figure 2A:
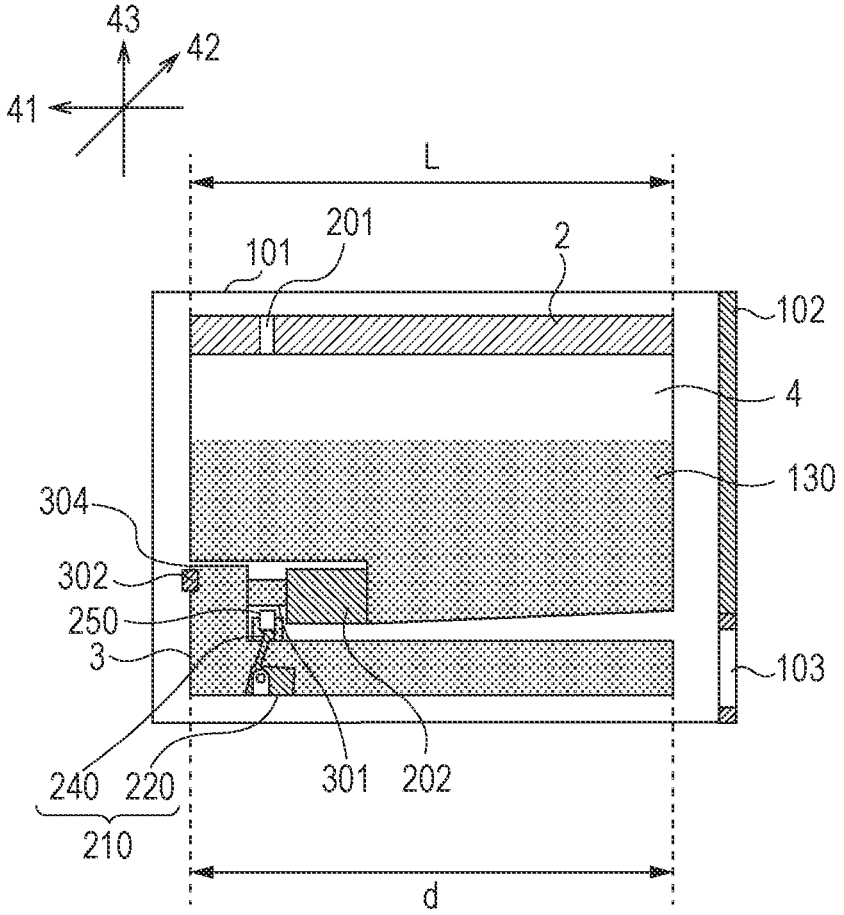
FIG. 2A is a cross-sectional view of an ink-cartridge mounting unit taken along the depth direction.
Figure 2B:
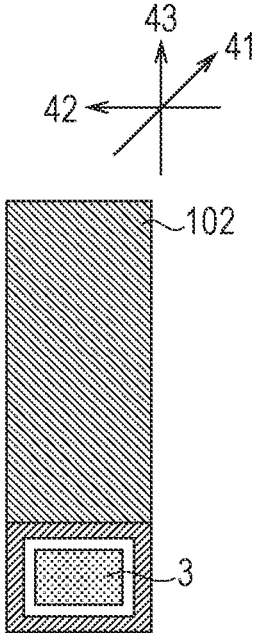
FIG. 2B is a diagram of an area of the ink-cartridge mounting unit corresponding to one ink cartridge.

FIGS. 2A and 2B are enlarged views of the ink-cartridge mounting unit 101. FIG. 2A is a cross-sectional view of the ink-cartridge mounting unit 101 taken along the depth direction. FIG. 2B is a diagram of an area of the ink-cartridge mounting unit 101 corresponding to one ink cartridge 2 viewed in the direction of arrow 41. The ink-cartridge mounting unit 101 is fitted with the ink cartridge 2. The ink cartridge 2 includes a chamber (a first ink chamber) 4 that contains ink 130. The first ink chamber 4 communicates with the atmosphere through a communicating portion 201. The ink-jet printing apparatus 1 includes a second ink chamber (a subtank) 3. In this case, the second ink chamber 3 is provided at the ink-cartridge mounting unit 101. The mounted ink cartridge 2 is coupled to the second ink chamber 3 via a liquid supply unit 202 and a coupling needle 301. When the ink cartridge 2 is mounted to the ink-jet printing apparatus 1, the ink 130 is supplied from the first ink chamber 4 of the ink cartridge 2 to the second ink chamber 3 of the ink-jet printing apparatus 1. The second ink chamber 3 is coupled to a head (not shown) to supply the ink to the head.

The second ink chamber 3 includes an air communication port 304. The air communication port 304 is provided with an air-liquid separation film 302. The second ink chamber 3 includes a rotatable member 210 that is rotationally supported therein. The rotatable member 210 includes a float 220 with a smaller specific gravity than that of the ink 130 and a detection portion 240 to be detected by a sensor 250 and extending from the float 220. When the liquid surface of the ink 130 stored in the second ink chamber 3 is higher than a predetermined height, the rotatable member 210 is positioned at a predetermined position owing to the buoyancy of the ink 130. The rotatable member 210 is rotated by gravity according to the position of the liquid surface of the ink 130 stored in the second ink chamber 3. The rotation of the rotatable member 210 causes the detection portion 240 to move, and the movement of the detection portion 240 (the position of the detection portion 240) is detected by the sensor 250. Thus, the amount of the ink 130 stored in the second ink chamber 3 can be determined.

While an example in which the rotatable member 210 for determining the amount of remaining ink is disposed in the second ink chamber 3 has been described, the rotatable member 210 does not need to be disposed in the second ink chamber 3. For example, the rotatable member 210 for determining the amount of remaining ink may be disposed in the first ink chamber 4 of the ink cartridge 2.

The second ink chamber 3 is conventionally disposed only deeper (more inside) than the mounted ink cartridge 2. The periphery of the second ink chamber 3 is covered by the casing 11. The user therefore cannot see the second ink chamber 3 from the outside of the ink-jet printing apparatus with the ink cartridge 2 mounted in the ink-cartridge mounting unit 101.

When the ink cartridge 2 is mounted, the ink 130 is supplied from the first ink chamber 4 of the ink cartridge 2 into the second ink chamber 3 of the ink-jet printing apparatus 1. Consequently, the ink 130 decreases in the first ink chamber 4. This may cause the user to have a feeling that the ink 130 in the first ink chamber 4 of the ink cartridge has decreased and the ink 130 has been consumed before printing (ejection of the ink 130) only by mounting the ink cartridge 2.

In contrast, in the ink-jet printing apparatus 1 shown in FIGS. 2A and 2B, the second ink chamber 3 extends in the depth direction vertically below the ink cartridge 2 to reach the vicinity of the window 103. The colorless window 103 is disposed at a vertically lower part of the area in which the ink cartridge 2 is mounted. This allows the user to view the condition in the second ink chamber 3 from the outside of the ink-jet printing apparatus 1 through the window 103 even in a state in which the ink cartridge 2 is mounted in the ink-cartridge mounting unit 101. Thus, even if the ink 130 stored in the first ink chamber 4 of the ink cartridge 2 has decreased, the user can view the second ink chamber 3 being filled with the ink 130 and is hardly given an incorrect feeling that the ink 130 has been consumed. Setting $0.5\ L \leq d \leq 1.2\ L$ decreases the capacity of the second ink chamber 3, where d is the length of the second ink chamber 3, and L is the length of the ink cartridge 2 in the direction in which the ink cartridge 2 is inserted into the ink-jet printing apparatus 1. This prevents a large amount of ink 130 from moving from the ink cartridge 2 to the second ink chamber 3 during ink injection, improving the user's feeling of usage and allowing efficient use of the inner space of the ink-jet printing apparatus 1. Preferably, $0.5\ L \leq d \leq L$ is satisfied, more preferably, $0.5\ L \leq d < L$ is satisfied, and still more preferably, $0.5\ L \leq d \leq 0.9\ L$ is satisfied.

Although an example in which the second ink chamber 3 is viewed through the transparent window 103 has been shown, the window 103 is not essential. In other words, the second ink chamber 3 may be directly exposed to the outside of the ink-jet printing apparatus 1. However, the window 103 may be provided in view of protection of the second ink chamber 3 and prevention of the evaporation of the ink 130 stored in the second ink chamber 3.

Figure 3:
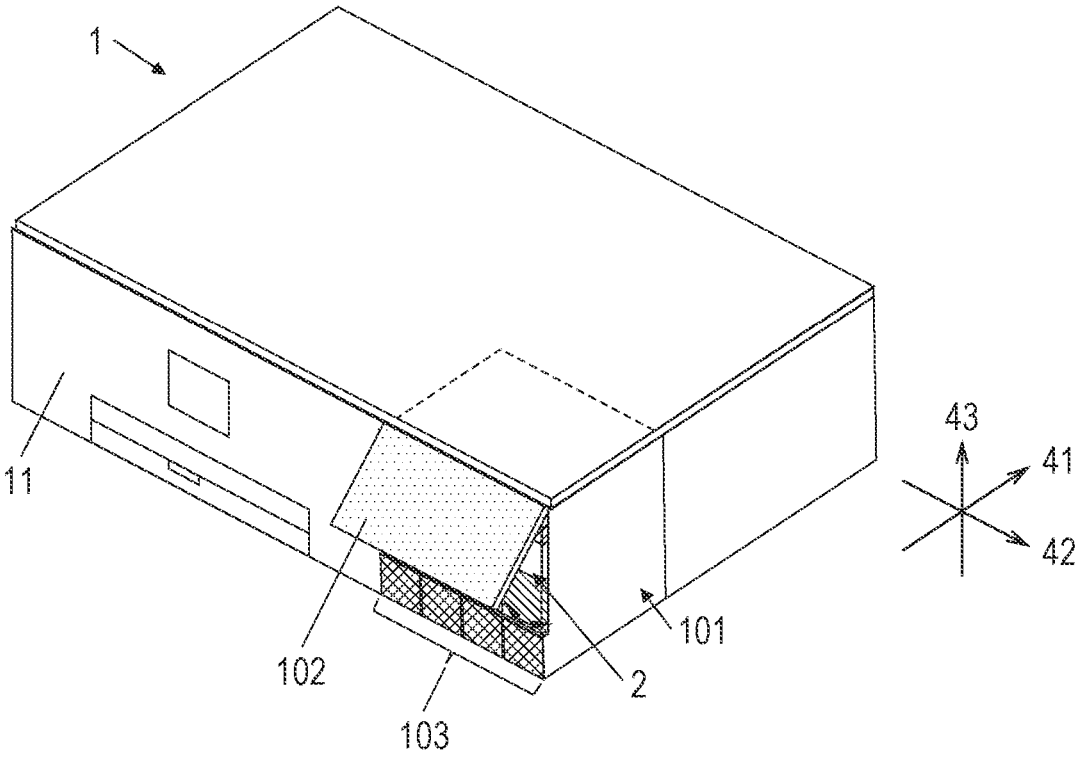
FIG. 3 is a perspective view of an ink-jet printing apparatus according to another embodiment of the present disclosure.
Figure 4A:
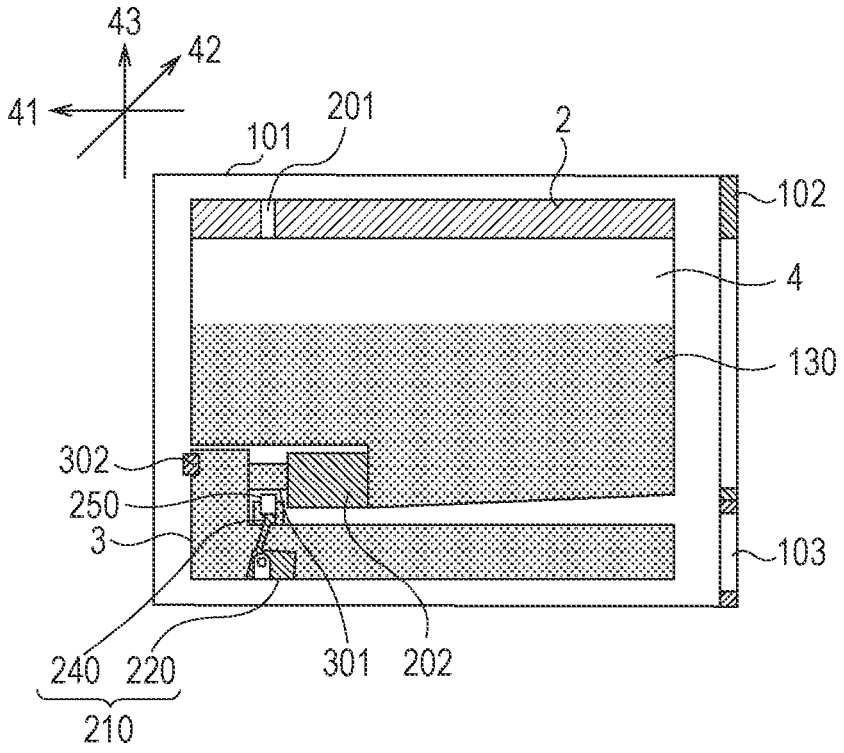
FIG. 4A is a cross-sectional view of an ink-cartridge mounting unit according to the embodiment.
Figure 4B:
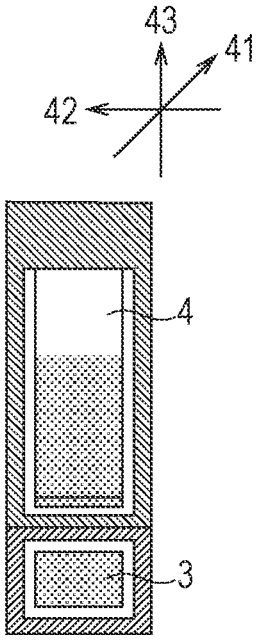
FIG. 4B is a diagram of an area of the ink-cartridge mounting unit corresponding to one ink cartridge.

FIG. 3 is a perspective view of an ink-jet printing apparatus according to another embodiment of the present disclosure, different from the ink-jet printing apparatus 1 illustrated in FIG. 1. FIGS. 4A and 4B are enlarged views of an ink-cartridge mounting unit 101 of the ink-jet printing apparatus 1 shown in FIG. 3. FIG. 4A is a cross-sectional view of the ink-cartridge mounting unit 101 taken along the depth direction. FIG. 4B is a diagram of an area of the ink-cartridge mounting unit 101 corresponding to one ink cartridge 2 viewed in the direction of arrow 41. The ink-jet printing apparatus 1 shown in FIG. 3 and FIGS. 4A and 4B differs from the ink-jet printing apparatus 1 shown in FIG. 1 and FIGS. 2A and 2B in that part of the case cover 102 provided at part of the ink-cartridge mounting unit 101 is transparent (colorless). The others are the same as the configuration illustrated in FIG. 1 and FIGS. 2A and 2B. Since part of the case cover 102 is transparent, the user can view the condition in the ink cartridge 2, that is, the condition in the first ink chamber 4, from the outside of the ink-jet printing apparatus 1 through the case cover 102. This configuration allows the user to view the progress of supply of the ink 130 from the first ink chamber 4 of the ink cartridge 2 to the second ink chamber 3 of the ink-jet printing apparatus 1.

Figure 5A:
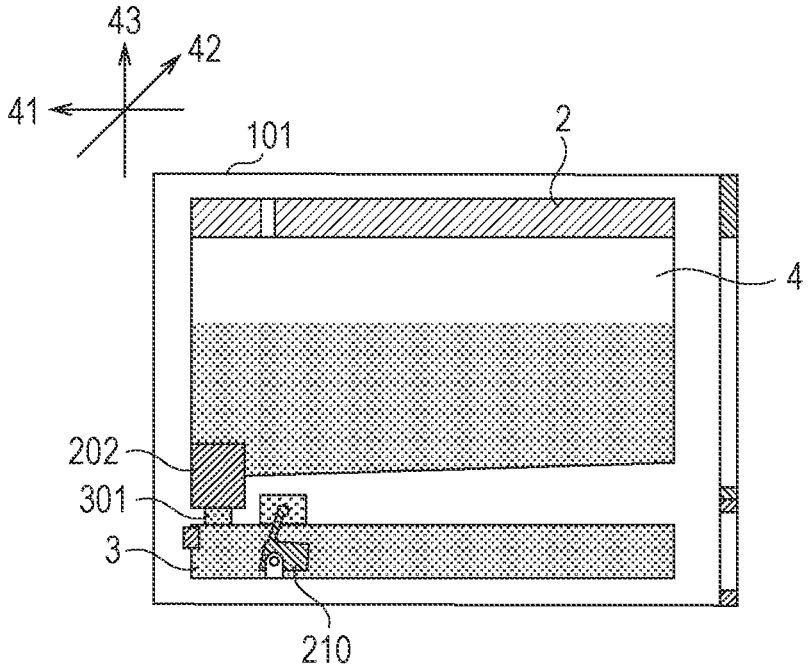
FIG. 5A is a cross-sectional view of an ink-cartridge mounting unit according to another embodiment of the present disclosure.
Figure 5B:
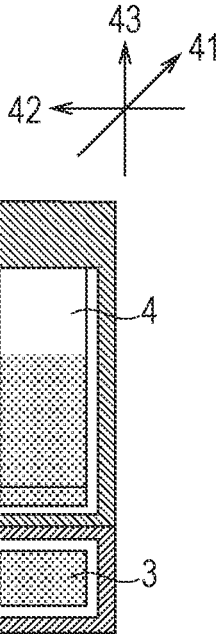
FIG. 5B is a diagram of an area of the ink-cartridge mounting unit corresponding to one ink cartridge.

FIGS. 5A and 5B show an ink cartridge and an ink-cartridge mounting unit different from those illustrated in FIGS. 2A and 2B and FIGS. 4A and 4B. FIG. 5A is a cross-sectional view of the ink-cartridge mounting unit 101 taken along the depth direction. FIG. 5B is a diagram of an area of the ink-cartridge mounting unit 101 corresponding to one ink cartridge 2 viewed in the direction of arrow 41. Although the basic configuration is the same as the configuration illustrated in FIGS. 4A and 4B, the ink-cartridge mounting unit 101 shown in FIGS. 5A and 5B is configured such that the ink cartridge 2 is mounted to the ink-cartridge mounting unit 101 in the direction of arrow 43, that is, in the vertical direction. At that time, the second ink chamber 3 is disposed vertically below the ink cartridge 2 as a whole. The rotatable member 210 is also disposed vertically below the ink cartridge 2. The first ink chamber 4 of the ink cartridge 2 and the second ink chamber 3 of the ink-jet printing apparatus 1 shown in FIGS. 5A and 5B can also be viewed by the user from the outside as with the configuration shown in FIGS. 4A and 4B. Thus, the ink cartridge 2 mounting direction may be along the vertical direction.

Figure 6B:
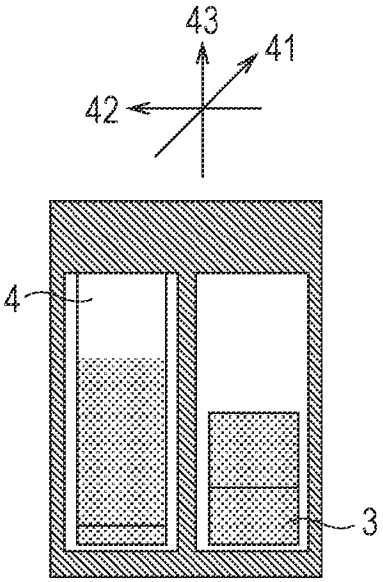
FIG. 6B is a diagram of an area of the ink-cartridge mounting unit corresponding to one ink cartridge.
Figure 6A:
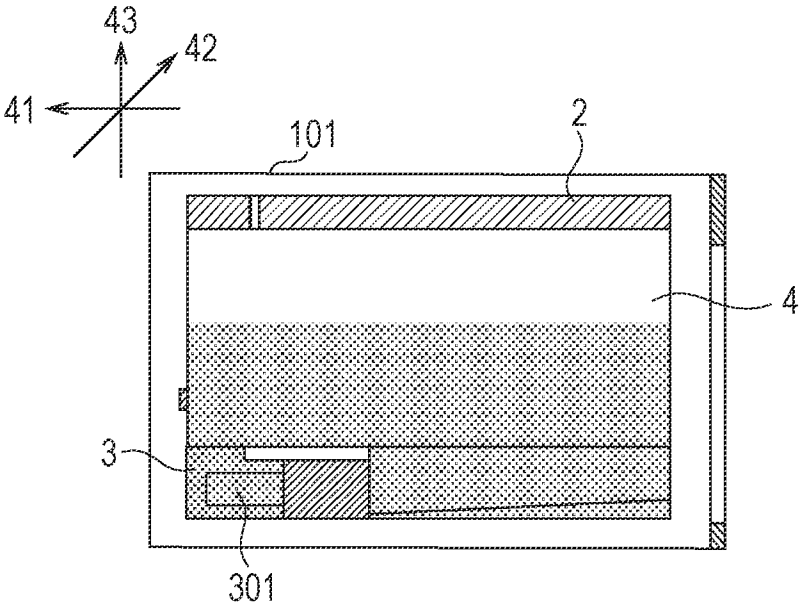
FIG. 6A is a cross-sectional view of an ink-cartridge mounting unit according to another embodiment of the present disclosure.

FIGS. 6A and 6B show an ink cartridge and an ink-cartridge mounting unit different from those illustrated in FIGS. 2A and 2B and FIGS. 4A and 4B. FIG. 6A is a cross-sectional view of the ink-cartridge mounting unit 101 taken along the depth direction. FIG. 6B is a diagram of an area of the ink-cartridge mounting unit 101 corresponding to one ink cartridge 2 viewed in the direction of arrow 41. The basic configuration is the same as the configuration illustrated in FIGS. 4A and 4B. However, in FIGS. 6A and 6B, the first ink chamber 4 of the ink cartridge 2 and the second ink chamber 3 of the ink-jet printing apparatus 1 are disposed side by side in the direction of arrow 42 in the horizontal direction. The first ink chamber 4 of the ink cartridge 2 and the second ink chamber 3 of the ink-jet printing apparatus 1 shown in FIGS. 6A and 6B can also be viewed by the user from the outside, as with the configuration illustrated in FIGS. 4A and 4B. Thus, the first ink chamber 4 and the second ink chamber 3 may be arranged side by side in the direction of arrow 42.

Figure 7A:
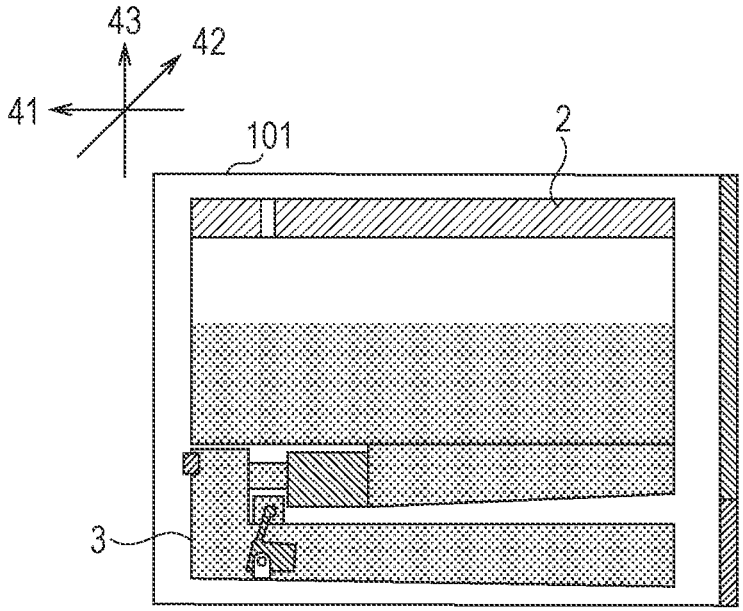
FIG. 7A is a cross-sectional view of an ink-cartridge mounting unit according to another embodiment of the present disclosure.
Figure 7B:
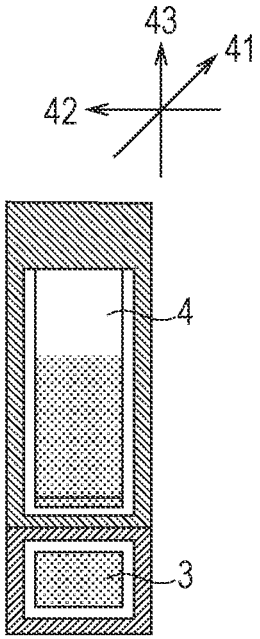
FIG. 7B is a diagram of an area of the ink-cartridge mounting unit corresponding to one ink cartridge.

FIGS. 7A and 7B show an ink cartridge and an ink-cartridge mounting unit different from those illustrated in FIGS. 2A and 2B and FIGS. 4A and 4B. FIG. 7A is a cross-sectional view of the ink-cartridge mounting unit 101 taken along the depth direction. FIG. 7B is a diagram of an area of the ink-cartridge mounting unit 101 corresponding to one ink cartridge 2 viewed in the direction of arrow 41. In the ink cartridge 2 and the second ink chamber 3 shown in FIGS. 7A and 7B, the bottom of the second ink chamber 3 is inclined relative to the direction in which the ink cartridge 2 is inserted into the ink-jet printing apparatus 1. The inclination allows the ink contained in the second ink chamber 3 to be guided to a predetermined location, thereby allowing the ink to be used up and providing high visibility when the remaining ink level is low.

Figure 8A:
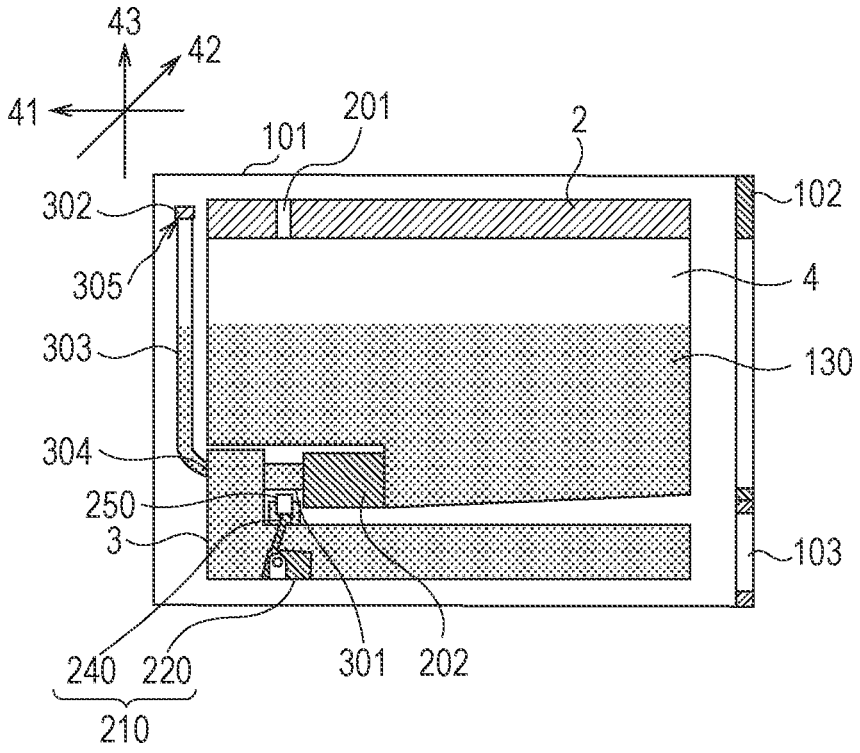
FIG. 8A is a cross-sectional view of an ink-cartridge mounting unit according to another embodiment of the present disclosure.
Figure 8B:
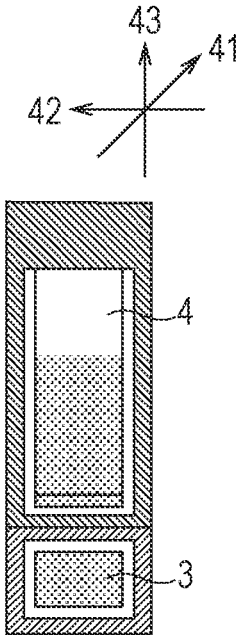
FIG. 8B is a diagram of an area of the ink-cartridge mounting unit corresponding to one ink cartridge.

FIGS. 8A and 8B show an ink cartridge and an ink-cartridge mounting unit different from those illustrated in FIGS. 2A and 2B and FIGS. 4A and 4B. FIG. 8A is a cross-sectional view of the ink-cartridge mounting unit 101 taken along the depth direction. FIG. 8B is a diagram of an area of the ink-cartridge mounting unit 101 corresponding to one ink cartridge 2 viewed in the direction of arrow 41. In the ink cartridge 2 and the second ink chamber 3 shown in FIGS. 8A and 8B, a tube 303 is connected to an air communication port 304 of the second ink chamber 3. An air-liquid separation film 302 is provided at an opening 305 at an end of the tube 303 (an end opposite to the air communication port 304). The opening 305 of the tube 303 is positioned vertically higher than the first ink chamber 4 of the ink cartridge 2. This configuration prevents the ink 130 in the tube 303 connected to the second ink chamber 3 from exceeding the liquid surface of the ink 130 in the cartridge 2. This prevents the ink 130 from coming into contact with the air-liquid separation film 302, improving the reliability in preventing leakage of the ink 130 from the second ink chamber 3.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-011245, filed Jan. 27, 2020, and No. 2020-183922, filed Nov. 2, 2020, which are hereby incorporated by reference herein in their entirety.

What is claimed is:

1. An ink-jet printing apparatus comprising:

an ink-cartridge mounting unit to which an ink cartridge having a first ink chamber configured to contain ink is to be mounted; and a second ink chamber configured to store ink supplied from the first ink chamber, wherein the ink-jet printing apparatus is configured such that, in a case where the ink cartridge is mounted to the ink-cartridge mounting unit, the second ink chamber can be viewed from outside of the ink-jet printing apparatus, and wherein $0.5\ L \leq d \leq 1.2\ L$ is satisfied, where d is a length of the second ink chamber, and L is a length of the ink cartridge in a direction in which the ink cartridge is inserted into the ink-jet printing apparatus, and wherein the second ink chamber includes an air communication port connected to a tube having an air-liquid separation film at an opening of the tube that is disposed vertically above the first ink chamber.

2. The ink-jet printing apparatus according to claim 1, wherein, in the case where the ink cartridge is mounted to the ink-cartridge mounting unit, the second ink chamber can be viewed from the outside of the ink-jet printing apparatus through a transparent member.

3. The ink-jet printing apparatus according to claim 1, wherein, in the case where the ink cartridge is mounted to the ink-cartridge mounting unit, the second ink chamber is directly exposed to the outside of the ink-jet printing apparatus.

4. The ink-jet printing apparatus according to claim 1, wherein, in the case where the ink cartridge is mounted to the ink-cartridge mounting unit, the second ink chamber extends vertically below the ink cartridge.

5. The ink-jet printing apparatus according to claim 1, wherein, in the case where the ink cartridge is mounted to the ink-cartridge mounting unit, the ink cartridge is mounted to the ink-cartridge mounting unit with a colored member opened and is then partially covered by the colored member.

6. The ink-jet printing apparatus according to claim 1, wherein, in the case where the ink cartridge is mounted to the ink-cartridge mounting unit, the ink cartridge can be viewed from the outside of the ink-jet printing apparatus.

7. The ink-jet printing apparatus according to claim 6, wherein, in the case where the ink cartridge is mounted to the ink-cartridge mounting unit, the ink cartridge can be viewed from the outside of the ink-jet printing apparatus through a transparent member.

8. The ink-jet printing apparatus according to claim 1, wherein the second ink chamber includes a rotatable member configured to detect an amount of ink stored in the second ink chamber.

9. The ink-jet printing apparatus according to claim 1, wherein the ink cartridge is mounted to the ink-cartridge mounting unit along a horizontal direction.

10. The ink-jet printing apparatus according to claim 1, wherein the ink cartridge is mounted to the ink-cartridge mounting unit along a vertical direction.

11. The ink-jet printing apparatus according to claim 10, wherein, in the case where the ink cartridge is mounted to the ink-cartridge mounting unit, the second ink chamber is disposed vertically below the ink cartridge.

12. The ink-jet printing apparatus according to claim 1, wherein, in the case where the ink cartridge is mounted to the ink-cartridge mounting unit, the second ink chamber is disposed horizontally side by side with respect to the ink cartridge.

13. The ink-jet printing apparatus according to claim 1, wherein $0.5\ L \leq d \leq L$ is satisfied.

14. The ink-jet printing apparatus according to claim 1, wherein $0.5\ L \leq d \leq 0.9\ L$ is satisfied.

15. The ink-jet printing apparatus according to claim 1, wherein a bottom of the second ink chamber is inclined.

16. The ink-jet printing apparatus according to claim 1, wherein the ink-jet printing apparatus is configured such that an ink level in the second ink chamber can be viewed through transparency in the second ink chamber.

17. The ink-jet printing apparatus according to claim 1, wherein the ink-jet printing apparatus is configured such that, in the case where the ink cartridge is mounted to the ink-cartridge mounting unit, the ink stored inside the second ink chamber can be viewed from outside of the ink-jet printing apparatus, and wherein a condition of the ink stored inside the second ink chamber is one of being filled and the ink-jet printing apparatus is configured such that progress of the second ink chamber being filled with ink can be viewed and be determined, and thereby a correct understanding regarding consumption the ink can be received.

* * * * *